US008707520B2

(12) United States Patent
Salice

(10) Patent No.: US 8,707,520 B2
(45) Date of Patent: Apr. 29, 2014

(54) DECELERATION DEVICE

(75) Inventor: Luciano Salice, Carimate (IT)

(73) Assignee: Arturo Salice S.p.A., Milan (IT)

( * ) Notice: Subject to any disclaimer, the term of this patent is extended or adjusted under 35 U.S.C. 154(b) by 0 days.

(21) Appl. No.: 13/519,824

(22) PCT Filed: May 10, 2011

(86) PCT No.: PCT/EP2011/057525

§ 371 (c)(1),
(2), (4) Date: Jun. 28, 2012

(87) PCT Pub. No.: WO2011/160889

PCT Pub. Date: Dec. 29, 2011

(65) Prior Publication Data

US 2013/0081230 A1 Apr. 4, 2013

(30) Foreign Application Priority Data

Jun. 25, 2010 (IT) ..... MI2010A1155

(51) Int. Cl.
*E05F 1/08* (2006.01)

(52) U.S. Cl.
USPC ..... 16/286; 16/288

(58) Field of Classification Search
USPC ..... 16/286–288, 50, 54, 56, 82, 294, 387, 16/262, DIG. 21; 188/268, 271, 290, 291, 188/296, 322.5, 281, 282.5, 282.8, 282.9
See application file for complete search history.

(56) References Cited

U.S. PATENT DOCUMENTS

| | | | | |
|---|---|---|---|---|
| 7,730,583 | B2 * | 6/2010 | Salice | 16/286 |
| 2007/0136990 | A1 * | 6/2007 | Salice | 16/282 |
| 2008/0276426 | A1 * | 11/2008 | Salice | 16/333 |

FOREIGN PATENT DOCUMENTS

| | | | |
|---|---|---|---|
| EP | 1344885 | A1 | 9/2003 |
| WO | WO 2006051074 | A1 * | 5/2006 |
| WO | WO 2007068740 | A1 * | 6/2007 |
| WO | WO 2007077232 | A1 * | 7/2007 |
| WO | WO-2007104731 | A1 | 9/2007 |

OTHER PUBLICATIONS

PCT International Search Report and Written Opinion issued on International Patent Application No. PCT/EP2011/057525.

* cited by examiner

*Primary Examiner* — Chuck Mah
(74) *Attorney, Agent, or Firm* — Edwards Wildman Palmer LLP

(57) ABSTRACT

A deceleration device comprises a cylindrical container (14) housing at least one friction disc (16) against at least an internal wall of the cylindrical container (14), and a movable cursor (18), actuated by an external element, for the actuation of the friction disc (16), the friction disc (16) being bound to the cylindrical container (14) through constraint means which permit a roto-translational motion in order to acquire a further sliding contact surface in addition to the internal wall of the cylindrical container (14) at the end of the initial translation phase of the cursor (18) in which the friction disc (16) is subjected to a mainly or completely translational motion.

16 Claims, 8 Drawing Sheets

DECELERATION DEVICE

FIELD

The present invention refers to a deceleration device applicable in particular to a hinge for furniture for the deceleration of its rotation.

BACKGROUND

Hinges for furniture have long been on the market, comprising an arm able to be fixed to a fixed element of the furniture and a box-shaped element able to be fixed to a door of the furniture, a first and a second rocker arm which operatively mutually connect the box-shaped body and the arm, and which define with them an articulated quadrilateral.

Such hinges usually have springs of various kinds for creating a retraction force by closing and/or opening the doors, on which they are applied. In such hinges the presence is desirable of deceleration devices of the movement of the doors caused by the elastic rotation of such springs. Such deceleration devices have the aim mainly to avoid the noises due to hard impacts against the body of the furniture during the closing of the doors.

Deceleration devices are known, based on the use of viscous means that are interposed among mutually moving parts.

In such case the efficiency of the deceleration device heavily depends on the ambient temperature in which the viscous means is used, being its viscosity clearly dependent from this.

For example, the use of a high viscosity means can be counterproductive if the ambient temperature is excessively lowered, as this can cause the blocking of the hinge, whereas the use of a low viscosity means can be inefficient if the ambient temperature is excessively raised (for example if on the hinge in question a beam of light is focused, produced by the artificial lighting present in an apartment). Deceleration systems have been provided which have a combined effect of a mechanical and viscous kind for the deceleration of the rotation of the hinge.

In particular reference is made to deceleration systems in which a plastic container filled with viscous fluid houses a friction disc rotatable against a sliding surface. A movable cursor due to the rotation of the hinge supports a drive element able to transform the translation of the cursor in a rotation of the friction disc.

In such systems the prevailing deceleration effect is in any case of a viscous kind and the above discussed drawbacks are therefore solved only marginally.

Such deceleration systems can also lament the drawback of having a limited efficiency and structural resistance together with a short useful life due to the high stress and wear to which their constituent parts are subjected.

SUMMARY

The technical task of the present invention is therefore to realize a deceleration device applicable in particular to a hinge for furniture for the deceleration of its rotation, which permits to eliminate the technical drawbacks lamented of the known art.

Within such technical task one aim of the invention is to realize a deceleration device which has an optimized braking efficiency independently from the ambient temperature conditions in which it is working.

Another aim of the invention is to realize a deceleration device which is mechanically extremely resistant, compact, durable and economic.

The technical task, and also these and other aims according to the present invention, are reached by realizing a deceleration device comprising a cylindrical container housing at least one friction disc against at least one internal wall of said cylindrical container, and a movable cursor, moved by an external element, for the actuation of said friction disc, characterized in that said friction disc is bound to said cylindrical container through constraint means permitting its translational motion, so to acquire a further sliding contact surface in addition to said internal wall of said cylindrical container at the end of an initial translation phase of said cursor in which said friction disc is subjected to a mainly or completely translational displacement.

Preferably said translational displacement is substantially radial and parallel to the translation direction of said cursor and it is caused by an external element in particular connected to a portion of a hinge for furniture, the rotary motion of which is transformed in the translational motion of the cursor.

When the translation of said cursor occurs in one direction, which in particular corresponds to a movement in the closing direction of a hinge for furniture associated to the deceleration device, said friction disc is subjected to a mainly or completely rotary displacement during an end phase of the translation of said cursor, in which the friction with said internal wall of said cylindrical container increases due to said further sliding contact surface.

Preferably said further sliding contact surface is created at least between the lateral surface of said internal wall of said cylindrical container and the lateral peripheral surface of said friction disc and/or between the lateral surface of recesses present on the bottom of said cylindrical container and the lateral surface of protrusions present on a base surface of said friction disc and engaged with said recesses.

Preferably said protrusions extend along mutually concentric circumferences and said recesses extend along mutually concentric circumferences.

Advantageously said friction disc has a radial clearance in said cylindrical container, and said roto-translational constraint means comprise a cylindrical rotary pin positioned inside a circular hole with a radial clearance.

Advantageously a radial clearance is present between each protrusion and the corresponding recess in which it is inserted.

Preferably said hole is a part of said friction disc and said rotary pin is a part of said cylindrical container or vice versa.

In a preferred embodiment of said constraint means the centre of said hole or the centre of said pin is offset with respect to the centre of the element to which it belongs.

In such case said constraint means are so configured that before said translational displacement said friction disc is concentric to said cylindrical container and at the end of said displacement said hole is concentric to said pin so that said friction disc during said rotary displacement substantially rotates upon itself without moving along said internal wall of said cylindrical container.

When the translation of said cursor occurs in an opposite direction, in particular corresponding to a movement in the opening direction of a hinge for furniture associated with the deceleration device, said friction disc is initially moved in a radial direction, in order to remove the contact with said further sliding surface and so to facilitate its further rotary motion.

In another preferred embodiment of said constraint means the centre of said hole and the centre of said pin are offset with respect to the centre of the element to which they belong.

In such case said constraint means are so configured that in an assembly position said friction disc and said container are offset in an opposite direction with respect to their rotation centre, so that said friction disc during said rotary displacement substantially rotates upon itself and at the same time moves along said internal wall of said cylindrical container, progressively approaching it until it interferes with the same, or away from it when moving in an opposite direction.

In a first preferred actuation of said friction disc, said cursor has a drive element engaged with a cam present in said friction disc.

In a second preferred actuation of said friction disc, a connecting rod is provided between said cursor and said friction disc.

BRIEF DECRIPTION OF THE DRAWINGS

Further characteristics and advantages of the invention will be more evident from the description of preferred but non exclusive embodiments of the hinge particularly for furniture according to the finding, illustrated in an indicative and non limitative way in the annexed drawings, in which.

DETAILED DESCRIPTION

Figure 1:
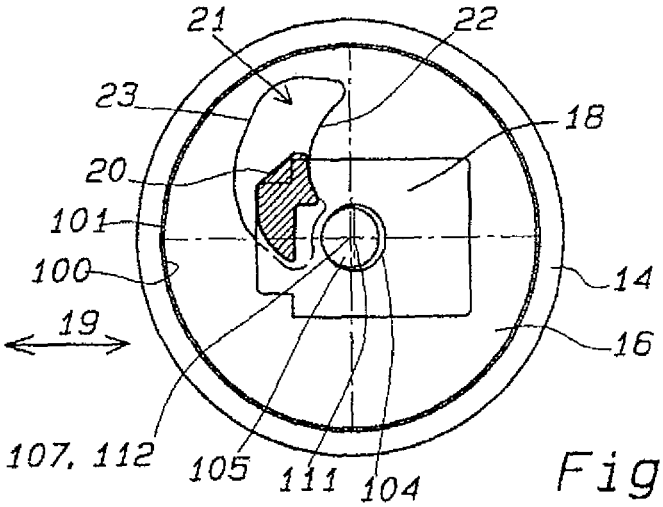
FIGS. 1, 2 and 3 show a plan view of the friction disc in the container of a deceleration device according to a first preferred embodiment of the invention, in the subsequent positions attained by the complete opening at the complete closing of a hinge associated to it.

With reference to the cited figures, a hinge for furniture is shown comprising a first and a second rocker arm 2, 3 operatively connecting a box-shaped body 4 with an arm 5.

The box-shaped body 4 is able to be fixed to a door of the furniture whereas the arm 5 is able to be fixed to a fixed element (not shown) of the furniture, for example to a side of the furniture.

In particular the first rocker arm 2 is pivoted with pin 7 to the box-shaped body 4 and with pin 8 to the arm 5, whereas the second rocker arm 3 is pivoted with pin 9 to the box-shaped body 4 and with pin 10 to the arm 5. The hinge pins 7, 8, 9 and 10 have parallel axes. The structure made by the box-shaped body 4 and the arm 5, operatively connected by the rocker arms 2 and 3 through the pins 7, 8, 9 and 10 makes an articulated quadrilateral.

Around the hinge pin 10 a spring 11 is present, having a first arm 12 associated with the arm 5 and a second arm 13 associated with the rocker arm 2.

The spring 11 in the end phase of closing of the door permits to create a retraction force upon the door for its spontaneous and precise closing.

To the hinge a deceleration device 1 is associated, comprising a cylindrical container 14 housing a fiction disc 16 against the internal wall of the container 14 itself, and a cursor 18 movable along one translation direction 19 during the rotation of the hinge for actuating the friction disc 16.

The friction disc 16 is placed inside the cylindrical container 14 with its own central axis oriented in the same direction of the axis of the cylindrical container 14, so that it rests with its own lower surface on the bottom of the cylindrical container 14.

The container 14 also has a support or cover 24 retaining the elements present inside it, and which can in particular be fixed to the external side of the bottom 15 of the box-shaped body 4.

The friction disc 16 is in particular so retained, that it can make a rotary translation inside the cylindrical container 14 with its own central axis maintained oriented, during the rotary translation, like the axis of the cylindrical container 14.

In particular the cover 24 has a window 25 along which the cursor 18 is guided in a translational way.

The cursor 18 has a quadrangular shape and can be provided on two opposite rectilinear sides of guide rectilinear ribs which can be inserted underneath the bottom of the box-shaped body 4 at the opposed rectilinear sides 27 of the window 25.

The cursor 18 has first means for taking up its movement during the opening of the hinge, which are distinct and separated by second means for taking up its movement during the closing of the hinge.

The first means for taking up the movement of the cursor 18 comprise ramps 35 provided on lateral opposed sites of the cursor 18, whereas the second taking-up means comprise a beveled edge 37 of one side of a quadrangular aperture 36 of the cursor 18.

The side of the aperture 36 having the beveled edge 37 is proximal and parallel with the frontal edge 38 of the cursor 18.

The cursor 18 is accessible to the rocker arm 3 through a window 41 of the bottom of the box-shaped body 4, which is superimposed on the window 25 of the cover 24.

The rocker arm 3 has a U-shaped transversal section with a back and lateral sides, upon each of which a control cam 42 is apically provided for the first means for taking-up the movement of the cursor 18, realized as a single piece with the second rocker arm 3.

A control cam 40 of the second means for taking-up the movement of the cursor 18 is made by a separated element mounted upon the rocker arm 3.

The element defining the control cam 40 has a profile 47 able to interfere with the beveled edge 37, a cylindrical groove 43 laterally open able to receive the pin 9 and a joint seat 44 for the back 45 of the second rocker arm 3.

The deceleration device 1 has fast attachment means with the box-shaped body 4 of the hinge, particularly comprising a jumper (not shown) with parallel shafts able to engage in suitable holes 52 and 55 of the box-shaped body 4 and holes 53, 56 of the cover 24.

The parallel shafts of the jumper make the hinge pins 7 and 9 of the rocker arms 2 and 3 to the box-shaped body 4.

Opposite means are provided between the assembly made by the container 14 and its cover 24 on one side and the box-shaped body 4 of the hinge on the other, in order to be mutually disposed in their correct position for their further blocking by means of the jumper.

The opposite means comprise at least one peg 54 on the cover 24, which can be inserted in a corresponding small hole 51 on the box-shaped body 4 of the hinge. The connection of the cover 24 with the container 14 is instead realized by means of snap elastic teeth 60 provided on the lateral surface of the one and inserted in elongated holes 61 provided on the lateral surface of the other.

According to a particularly advantageous aspect of the invention the friction disc 16 is bound to the cylindrical container 14 through constraint means permitting its roto-translational motion in order to acquire a further sliding contact surface with the internal wall of the cylindrical container 14 at the end of an initial phase of translation of the cursor 18, in which the friction disc 16 is subjected to a mainly or completely translational displacement, and in particular substantially radial.

Advantageously the friction disc 16 is instead subjected to a mainly or completely rotary displacement during the end phase of translation of the cursor 18 in which the fiction with the internal wall of the cylindrical container 14 increases due to the further sliding contact surface.

The further sliding contact surface is that which creates between the lateral surface 100 of the internal wall of the cylindrical container 14 and the peripheral lateral surface 101 of the friction disc 16.

The further sliding contact surface is also advantageously the one which creates between the lateral surface 102 of recesses 29 present on the bottom of the cylindrical container 14 and the lateral surface 103 of protrusions 28 present on the base surface of the friction disc 16 and engaged with the recesses 29.

The protrusions 28 extend along mutually concentric circumferences and in the same way the recesses 29 extend along mutually concentric circumferences.

For permitting the radial displacement of the friction disc 16, this latter has a radial clearance in the cylindrical container 14, and at the same time a radial clearance is present between each protrusion 28 and the corresponding recess 29 in which it is inserted.

The roto-translational constraint means comprise a cylindrical rotation pin 105 positioned with a radial clearance in a circular hole 104.

In the illustrated embodiments, the hole 104 is a part of the friction disc 16 whereas the cylindrical pin 105 is integral with the bottom of the cylindrical container 14.

In the first and second preferred embodiment of the deceleration device, to which FIGS. 1 to 12 refer, the centre 111 of the hole 104 is offset with respect to the centre 106 of the friction disc 16, whereas the centre 112 of the pin 105 is centered with respect to the centre 107 of the base of the cylindrical container 14.

Figure 13:
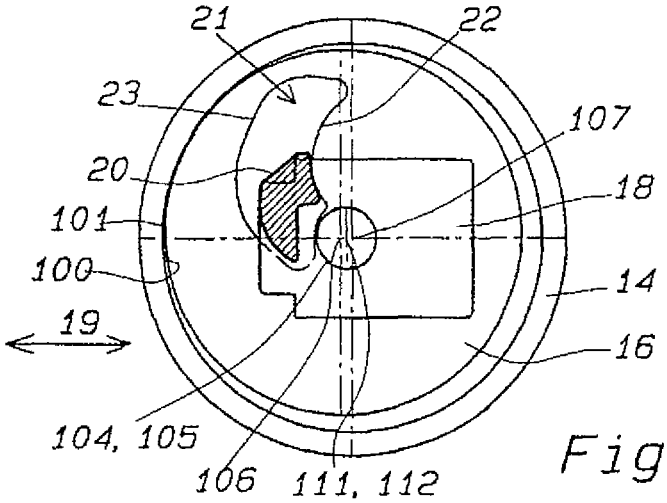
FIGS. 13, 14 and 15 show a plan view of the friction disc in the container of a deceleration device according to a third preferred embodiment of the invention, in the subsequent positions attained by the complete opening at the complete closing of the hinge associated to it.
Figure 14:
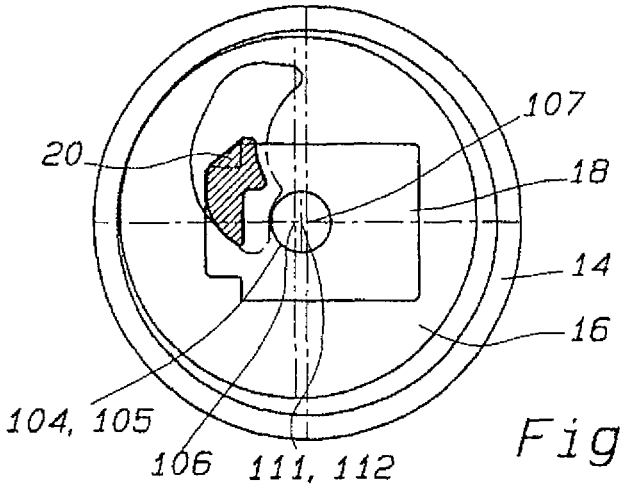
Figure 15:
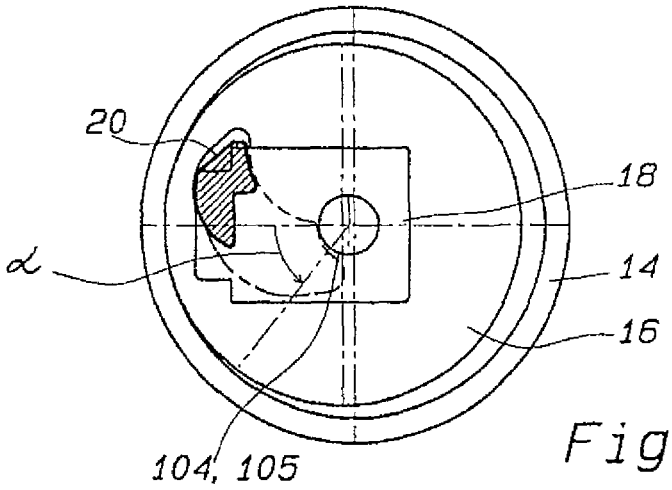
Figure 18:
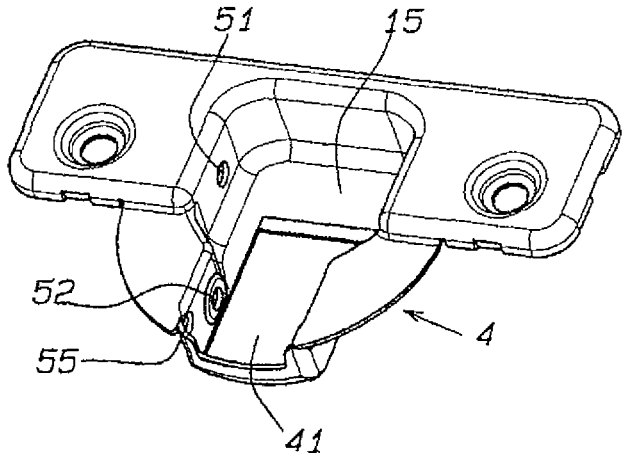
FIG. 18 shows a perspective view of the box-shaped body of the hinge having the deceleration device of FIG. 16.
Figure 16:
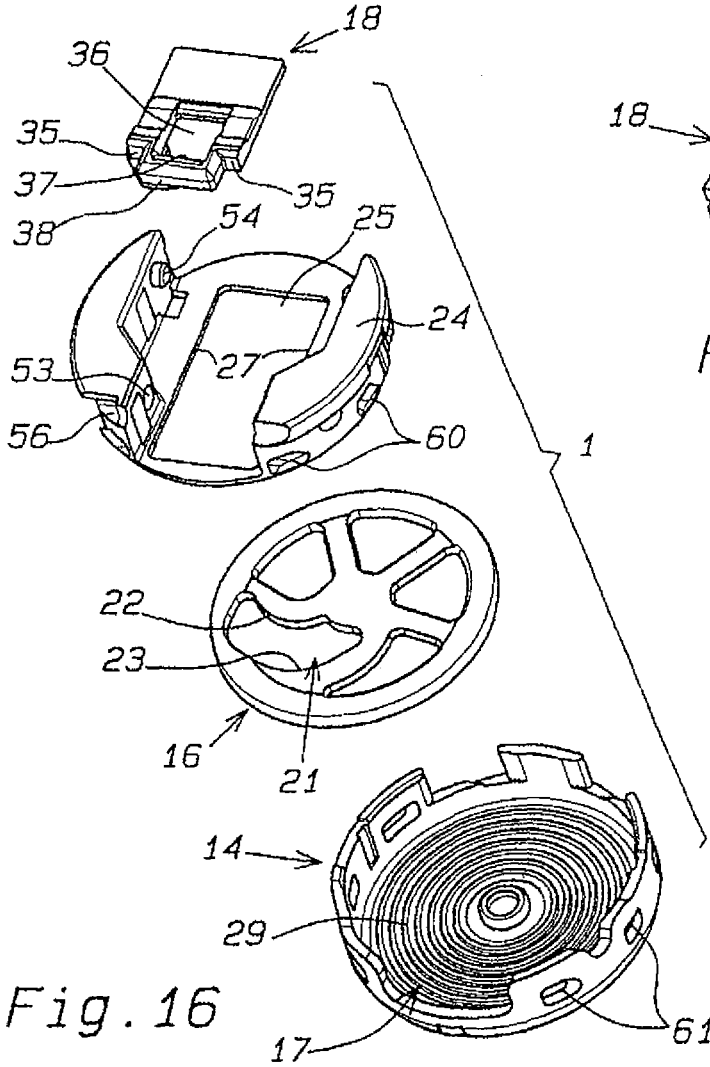
FIG. 16 shows a perspective exploded view of the deceleration device according to a first preferred embodiment of the invention.
Figure 17:
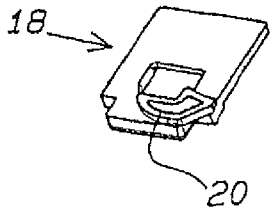
FIG. 17 shows a different perspective view of the cursor of FIG. 16.
Figure 19:
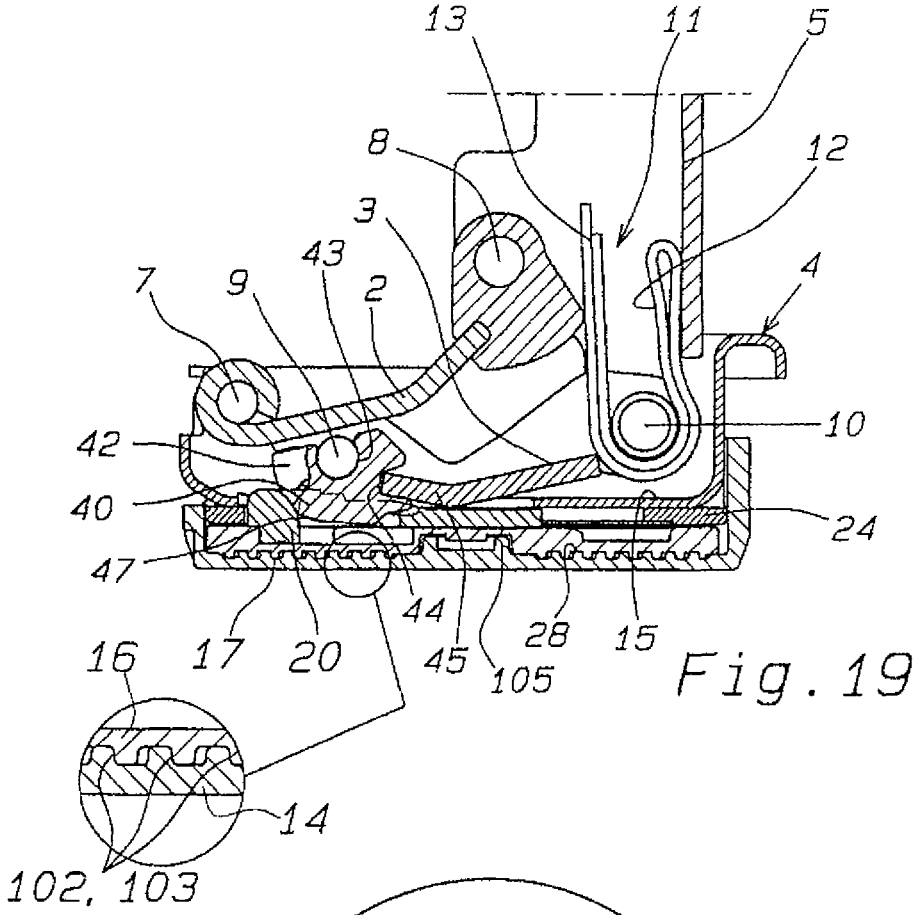
FIG. 19 shows a sectional lateral elevation view of the hinge having the deceleration device of FIG. 16, in the closing position of the hinge.
Figure 20:
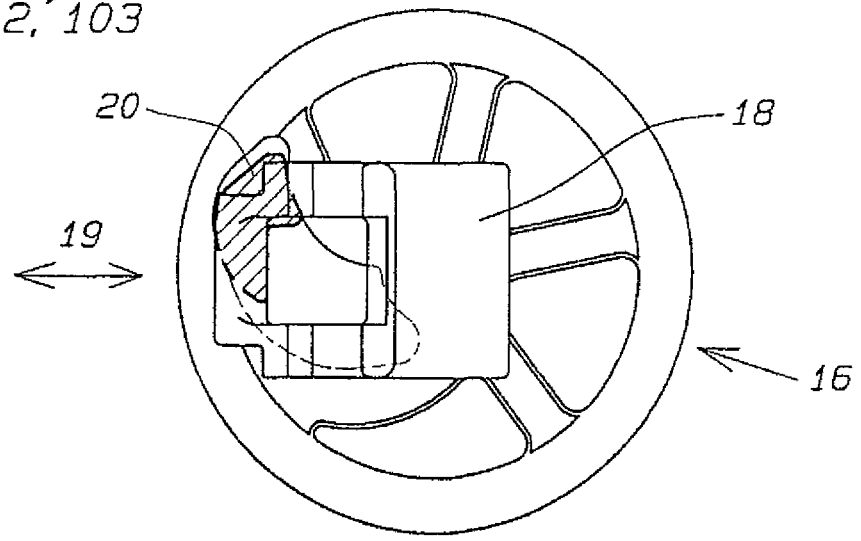
FIG. 20 shows a plan view of the deceleration device of FIG. 16, in the closing position of the hinge corresponding to that illustrated in FIG. 3.
Figure 21:
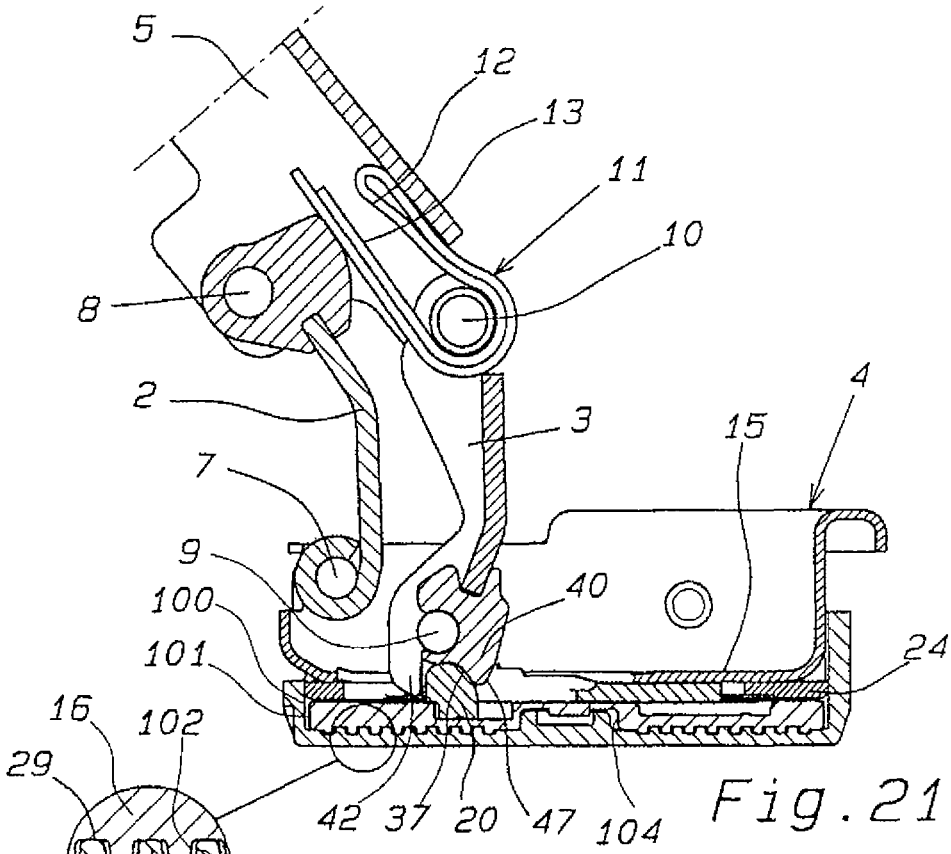
FIG. 21 shows a sectional lateral elevation view of the hinge having the deceleration device of FIG. 16, in the closing position of the hinge.
Figure 22:
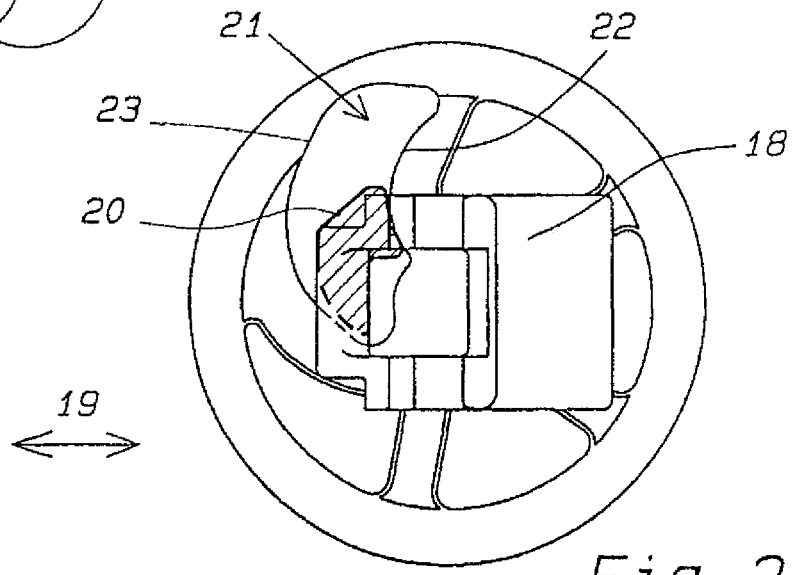
FIG. 22 shows a plan view of the deceleration device of FIG. 16, in the opening position of the hinge corresponding to that illustrated in FIG. 6.

The constraint means are so configured that before the translational displacement the friction disc 16 is concentric to the cylindrical container 14 and at the end of the translational displacement the hole 104 is concentric to the pin 105, so that the friction disc 16 during the subsequent rotary displacement substantially rotates upon itself without moving along the internal wall of the cylindrical container 14. In the third preferred embodiment of the deceleration device instead, to which FIGS. 13 to 15 refer, not only the centre 111 of the hole 104 is offset with respect to the centre 106 of the friction disc 16, but also the centre 112 of the pin 105 is offset with respect to the centre 107 of the base of the cylindrical container 14.

In this case the constraint means are so configured that the friction disc 16 during its rotary displacement substantially rotates upon itself and at the same time moves along the internal wall of the cylindrical container 14 until reaching a position in which an interference is created between disc and container.

For the actuation of the friction disc 16, in a first case the cursor 18 is provided with a drive element 20 engaged in a cam 21 present in the friction disc 16, as shown in the first and in the third preferred embodiment of the deceleration device, to which FIGS. 1 to 6 and 13 to 15 refer, and in a second case a connecting rod 108 is provided, having one end 109 hinged to the cursor 18 and one end 110 hinged to the friction disc 16, as shown in the second preferred embodiment of the deceleration device, to which FIGS. 7 to 12 refer. Here it is also noted that the end 109 of the connecting rod 108, the hole 104 and the pin 105 are aligned and parallel to the direction of translation 19 of the cursor 18.

In the first case in particular, the drive element 20 is selectively engaged with a first length 22 of the profile of the cam 21 during the opening of the hinge and with a second length 23 of the profile of the cam 21 during the closing phase of the hinge.

In the cylindrical container 14 a viscous fluid is optionally present, in which the friction disc 16 is immersed in order to reach a combined braking effect of the mechanical and viscous kind during the closing of the hinge.

The function of the hinge, initially with reference to the first preferred embodiment of the deceleration device, is the following.

In the position of complete opening of the hinge (FIG. 1) the constraint means have a configuration in which between the centre 111 of the hole 104 and the centre 112 of the pin 105 a distance is present which is parallel to the direction of translation 19 of the cursor 18, and substantially the same distance separates the peripheral lateral surface 101 of the friction disc 16 from the lateral surface 100 of the internal wall of the cylindrical container 14 in which the friction disc 16 is concentrically positioned, and the lateral surface 103 of the protrusions 28 from the lateral surface 102 of the recesses 29 which are concentric with the protrusions.

Figure 2:
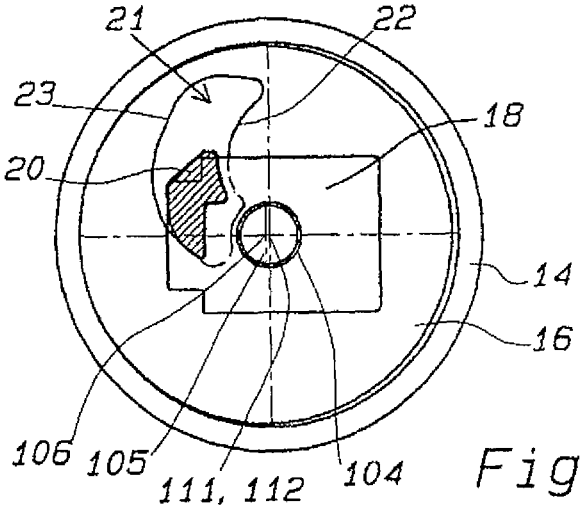
Figure 3:
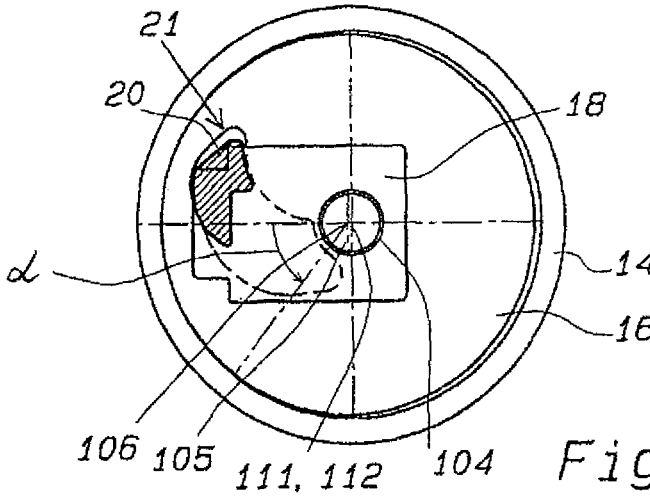
Figure 4:
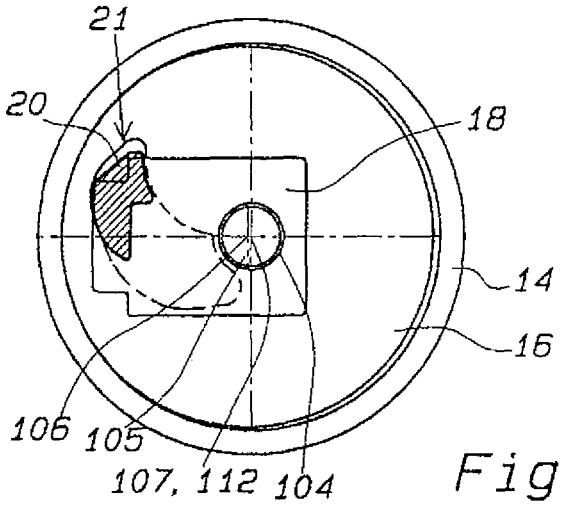
FIGS. 4, 5 and 6 show a plan view of the friction disc in the container of the deceleration device according to a first preferred embodiment of the invention, in the subsequent positions attained by the complete closing at the complete opening of the hinge associated to it.
Figure 5:
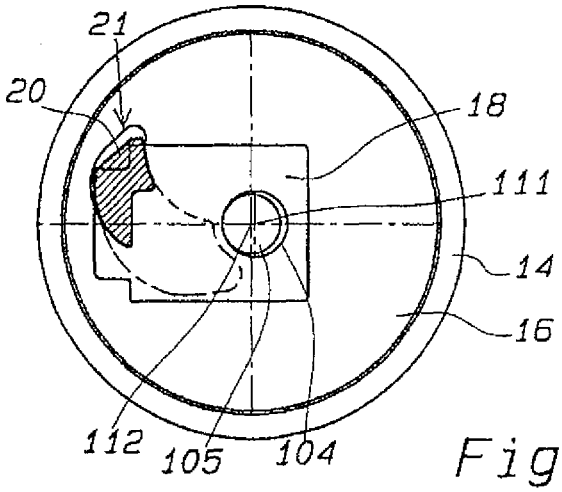

In a certain instant of the rotation of the hinge in the closing direction, the control cam 40 rotating around the pin 9 interferes and begins to push with its profile 47 against the beveled edge 37 so causing the translation of the cursor 18. The drive element 20 initially separates from the length 22 of the cam 1 and after having abutted against the length 23 of the cam 21 it begins pushing it so translating in a direction substantially parallel to the translation direction 19 of the cursor 18, the fiction element 16 until bringing the lateral peripheral surface 101 of the friction disc 16 in a substantially tangential contact with the lateral surface 100 of the internal wall of the cylindrical container 14, and the lateral surface 103 of the protrusions 28 in a substantially tangential contact with the lateral surface 102 of the recesses 29. At the end of this substantially radial displacement 1*e* of the friction disc 16 the centre 111 of the hole 104 and the centre 112 of the pin 105 are coincident (FIG. 2).

During the end phase of rotation of the hinge in the closing direction (FIG. 3), the cam 21 determines the rotation of the friction disc 16 upon itself of an angle $\alpha$.

It is clear that in this phase the friction between the friction disc 16 and the container 14 increases significantly increases, due to the fact that a broad further surface of sliding contact is present which, as it was described before, derives from the lateral contact between the friction disc 16 and the cylindrical container 14 and from the lateral contact between the protrusions 28 and the recesses 29.

During the initial phase of rotation of the hinge in the opening direction, the cursor 18 is made in translation in the opposite direction.

The drive element 20 initially separates itself from the length 23 of the cam 21 and after having come in contact with the length 22 of the cam 21 it begins pushing it causing its translation in a direction substantially parallel to the translation direction 19 of the cursor 18, the friction element 16 so separating immediately the lateral peripheral surface 101 of the friction disc 16 from the lateral surface 100 of the internal wall of the cylindrical container 14, and the lateral surface 103 of the protrusions 28 from the lateral surface 102 of the recesses 29. The translation of the friction element 16 ends when the hole 104 comes in a tangential abutment with the pin 105 in which the distance between the centre 111 of the hole 104 and the centre 112 of the pin 105 (FIG. 5) is again created.

Figure 6:
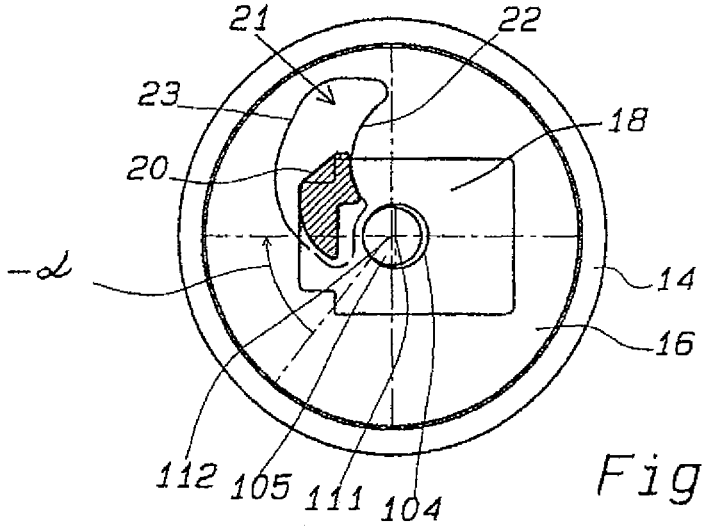
Figure 7:
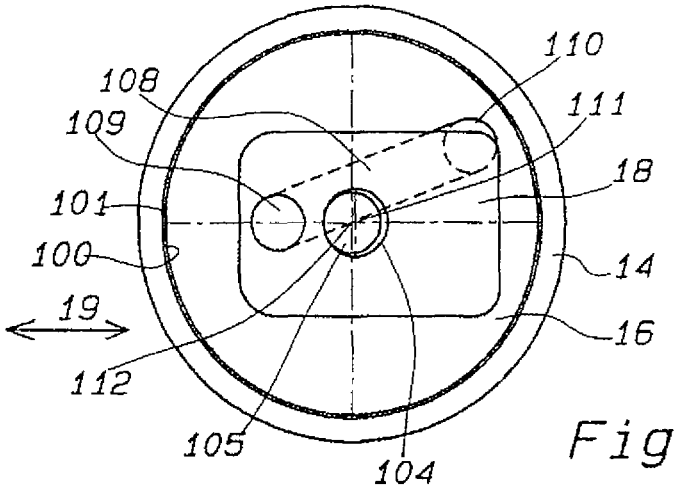
FIGS. 7, 8 and 9 show a plan view of the friction disc in the container of a deceleration device according to a second preferred embodiment of the invention, in the subsequent positions attained by the complete opening at the complete closing of the hinge associated to it.
Figure 8:
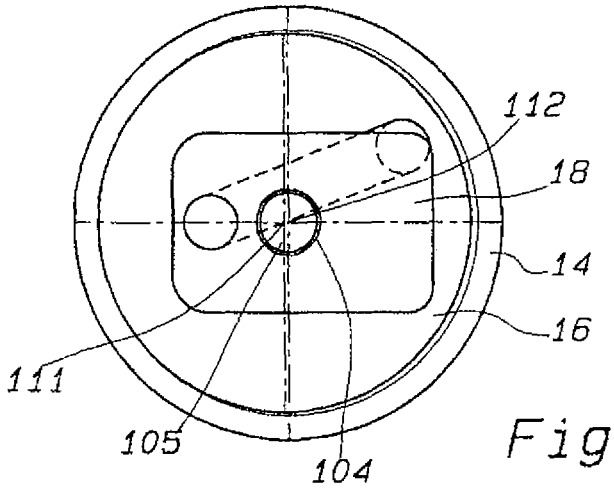
Figure 9:
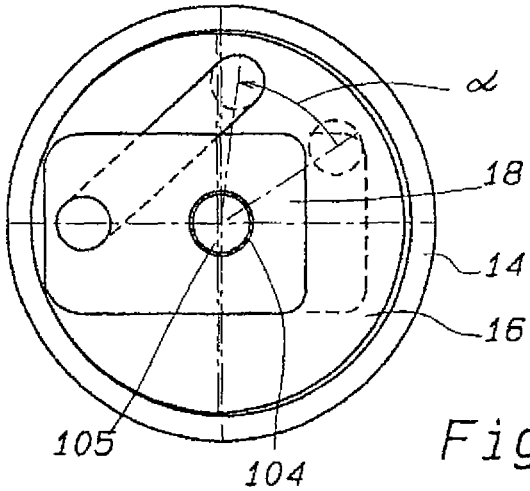
Figure 10:
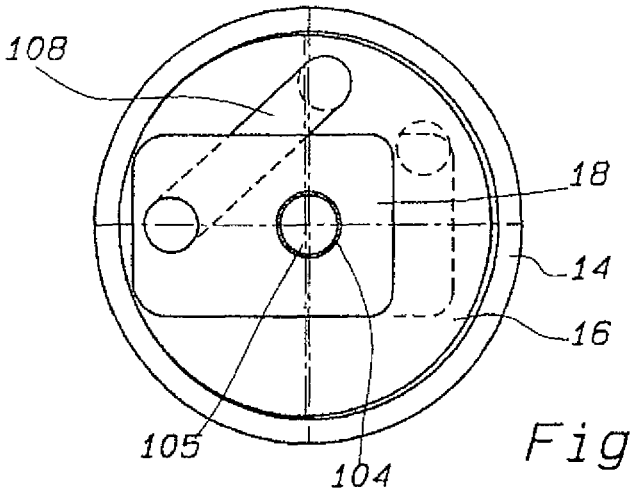
FIGS. 10, 11 and 12 show a plan view of the friction disc in the container of the deceleration device according to a second preferred embodiment of the invention, in the subsequent positions attained by the complete closing at the complete opening of the hinge associated to it.
Figure 11:
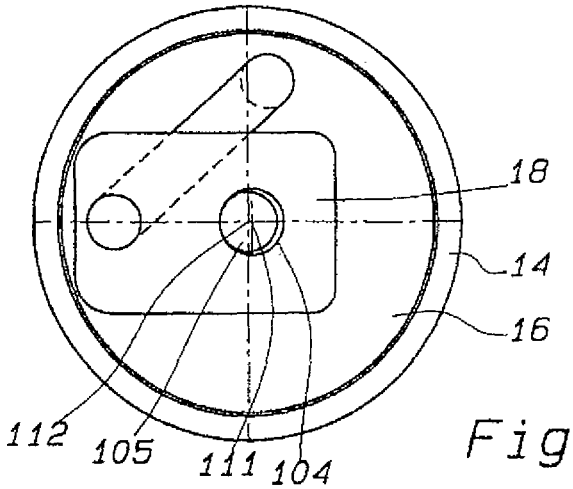
Figure 12:
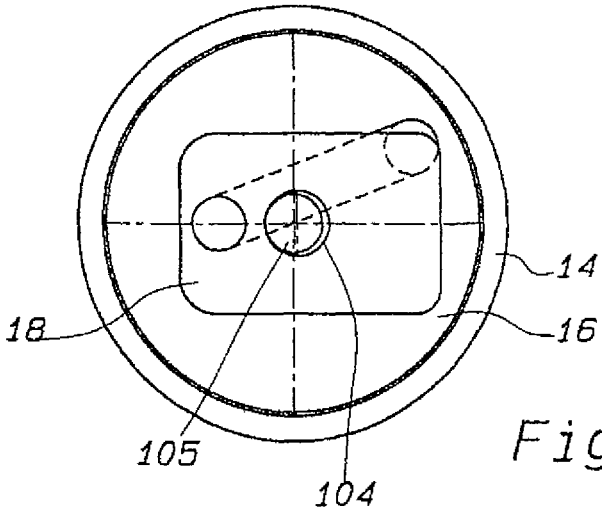

During the subsequent rotation phase of the hinge in the opening direction, the cam 21 causes the rotation of the friction disc 16 upon itself of an angle $-\alpha$ (FIG. 6). The function of the hinge, with reference to the second preferred embodiment of the deceleration device, is analogous to that described before with reference to the first preferred embodiment of the deceleration device, except for the fact that the movement is transmitted to the friction disc 16 by the connecting rod 108 which in turn is moved by the cursor 18, and therefore it shall not be repeated.

The function of the hinge, with reference to the third preferred embodiment of the deceleration device, differs from that above described with reference to the first preferred embodiment of the deceleration device, due to the fact that now both the centre 111 of the hole 104 is offset with respect to the centre of the friction disc 16, and the centre 112 of the pin 105 is offset with respect to the centre of the base of the cylindrical container 14.

No radial clearance instead exists between the hole 104 and the pin 105.

In this case there exists no more one initial translation phase of the cursor 18 in the closing direction, in which the fiction element 16 moves in a direction substantially parallel with the translation direction 19 of the cursor 18, until it brings the lateral peripheral surface 101 of the friction disc 16 in a tangential abutment with the lateral surface 100 of the internal wall of the cylindrical container 14, and the lateral surface 103 of the protrusions 28 in tangential abutment with the lateral surface 102 of the recesses 29, but a single translation phase of the cursor 18 in the closing direction, in which the friction disc 16 rotates upon itself and at the same time its peripheral surface moves approaching and then sliding along the lateral surface of the internal wall of the cylindrical container 14 against which the contact pressure progressively increases.

In such case the increment of the fiction between the friction disc 16 and the cylindrical container 14 is due to the synergic combination of two causes, that is the increase of the sliding surface and the increase of the contact pressure.

Such solution therefore lends itself particularly to an use in a deceleration device of the kind with a combined viscous/mechanical effect or exclusively mechanical one, in order to completely eliminate the drawbacks bound to the use of a viscous fluid. In all three embodiments described before a facilitated opening movement of the hinge is obtained, with respect to its closing movement, due to the fact that in the opening phase the peripheral surface 100 of the disc 16 does not interfere with the internal peripheral surface 101 of the container 14, consequently exerting a lower braking effect.

In the hinge of the present invention the deceleration device finally has a high efficiency, both if it is based on a purely mechanical effect, or on a combined effect of a mechanical and viscous kind, being in any case prevailing the mechanical effect.

The deceleration device so conceived is susceptible to numerous changes and variations, all within the inventive concept; furthermore all details can be substituted with technically equivalent elements.

In practice the used materials, and also its dimensions, can be of any kind according to the needs and the state of the art.

The invention claimed is:

1. A deceleration device comprising a cylindrical container housing at least one friction disc having a lower surface in sliding contact with a base of said cylindrical container, said cylindrical container and said friction disc having respective lateral surfaces, and one movable cursor, actuated by an external element and operatively connected to the friction disk, wherein said friction disc is bound to said cylindrical container through constraint means configured and adapted to permit movement of said friction disc according to a roto-translational motion inside and with respect to an internal wall of said cylindrical container bringing said lateral surfaces into further sliding contact with each other, thereby effecting further sliding contact between said lateral surfaces in addition to the sliding contact between said lower surface of the friction disc and base of said cylindrical container.

2. The deceleration device recited in claim 1, wherein the roto-translational motion includes an initial mainly or completely translational displacement substantially radial and parallel to the translational direction of said cursor.

3. The deceleration device recited in claim 1, wherein said friction disc is subjected to a mainly or completely rotational displacement during an end translation phase of said cursor in which friction with said internal wall of said cylindrical container increases, by said further sliding contact of said lateral surfaces.

4. The deceleration device recited in claim 1, wherein said sliding contact occurs between the lateral surface of said internal wall of said cylindrical container and the lateral peripheral surface of said friction disc.

5. The deceleration device recited in claim 1, wherein said sliding contact occurs between a lateral surface of recesses present at the bottom of said cylindrical container and a lateral surface of protrusions present on a base surface of said friction disc and engaged with said recesses.

6. The deceleration device as recited in claim 5, wherein said protrusions extend along mutually concentric circumferences and said recesses extend along mutually concentric circumferences.

7. The deceleration device recited in claim 5, wherein a radial clearance is present between each protrusion and the corresponding recess in which it is inserted.

8. The deceleration device as recited in claim 1, wherein said friction disc has a lateral surface radial clearance in said cylindrical container, and that said roto-translational constraint means comprise a cylindrical rotary pin of said cylindrical container positioned in a circular hole defined by said friction disc with a radial clearance.

9. The deceleration device recited in claim 8, wherein said hole belongs to said friction disc and said rotary pin belongs to said cylindrical container or vice versa.

10. The deceleration device recited in claim 8, wherein a centre of said hole or a centre of said pin is offset with respect to the centre of the element to which it belongs.

11. The deceleration device recited in claim 8, wherein said constraint means are so configured that before said translational displacement said friction disc is concentric to said cylindrical container and at the end of said translational displacement said hole is concentric to said pin so that said friction disc during said rotary motion substantially rotates on itself without moving along said internal wall of said cylindrical container.

12. The deceleration device recited in claim 8, wherein the centre of said hole and the centre of said pin are offset with respect to the centre of the element to which they belong.

13. The deceleration device recited in claim 8, wherein such constraint means are so configured that said friction disc during said rotary displacement substantially rotates on itself and at the same time moves along said internal wall of said cylindrical container progressively approaching it.

14. The deceleration device as recited in claim 1, wherein said cursor includes a drive element engaged in a cam defined by said friction disc for actuation of said friction disc.

15. The deceleration device recited in claim 1, further including a connection rod having a first end hinged to said cursor and a second end hinged to said friction disc for actuating said friction disc.

16. A furniture hinge comprising at least one element articulately connecting a hinge arm with a box-shaped body, wherein to the box-shaped element a deceleration device as recited in claim 1 is associated.

* * * * *